US005367837A

United States Patent [19]

Tolkowsky

[11] Patent Number: 5,367,837

[45] Date of Patent: Nov. 29, 1994

[54] GEMSTONE HOLDING APPARATUS

[76] Inventor: Gabriel S. Tolkowsky, 30 Maria Lei, Antwerpen,

[21] Appl. No.: 91,476

[22] Filed: Jul. 15, 1993

Related U.S. Application Data

[63] Continuation of Ser. No. 904,693, Jun. 26, 1992, abandoned.

[30] Foreign Application Priority Data

Jul. 3, 1991 [ZA] South Africa ..... 91/5148

[51] Int. Cl.[5] ..... B24B 19/00

[52] U.S. Cl. ..... 451/389; 451/390; 451/365; 451/460

[58] Field of Search ..... 51/229, 216 LP, 217 R, 51/217 L, 216 ND, 125.5, 277; 269/22, 329

[56] References Cited

U.S. PATENT DOCUMENTS

| | | | |
|---|---|---|---|
| 2,829,472 | 4/1958 | Salzer | 51/125 |
| 3,120,087 | 2/1964 | Hollonay | 51/277 |
| 4,110,937 | 9/1978 | Bein | 51/216 LP |
| 4,164,099 | 8/1979 | Grant | 51/216 LP |
| 4,691,481 | 9/1987 | Souch | 51/277 |
| 4,924,637 | 5/1990 | Ikimi | 51/277 |

FOREIGN PATENT DOCUMENTS

| | | | |
|---|---|---|---|
| 99629 | 4/1925 | Germany . | |
| 863051 | 1/1978 | Germany . | |
| 17965 | 11/1927 | Netherlands | 51/229 |
| 907353 | 9/1990 | South Africa . | |
| 560581 | 1/1978 | Switzerland . | |
| 565419 | 11/1944 | United Kingdom | 51/229 |
| 633561 | 12/1949 | United Kingdom | 51/229 |
| 1546589 | 5/1979 | United Kingdom . | |
| 1551716 | 8/1979 | United Kingdom . | |

*Primary Examiner*—Bruce M. Kisliuk
*Assistant Examiner*—Eileen P. Morgan
*Attorney, Agent, or Firm*—Stevens, Davis, Miller & Mosher

[57] ABSTRACT

During polishing of a gemstone (30, 100, 200), a coolant is passed in heat exchange relationship with the gemstone to remove heat. This reduces the risk of temperature degradation of the gemstone. In practice, this can be achieved by passing a fluent coolant through a coolant chamber (34, 124, 214) which forms part of the apparatus that is used to hold the gemstone during polishing and which is in heat exchange relationship with the gemstone held by the apparatus.

5 Claims, 3 Drawing Sheets

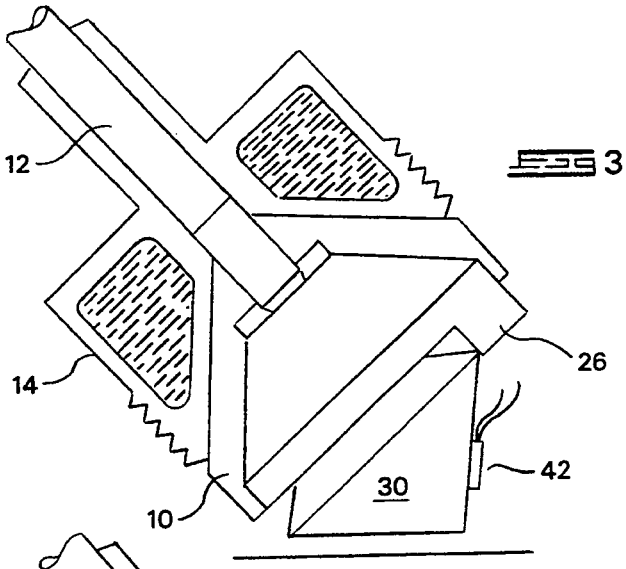
FIG 3
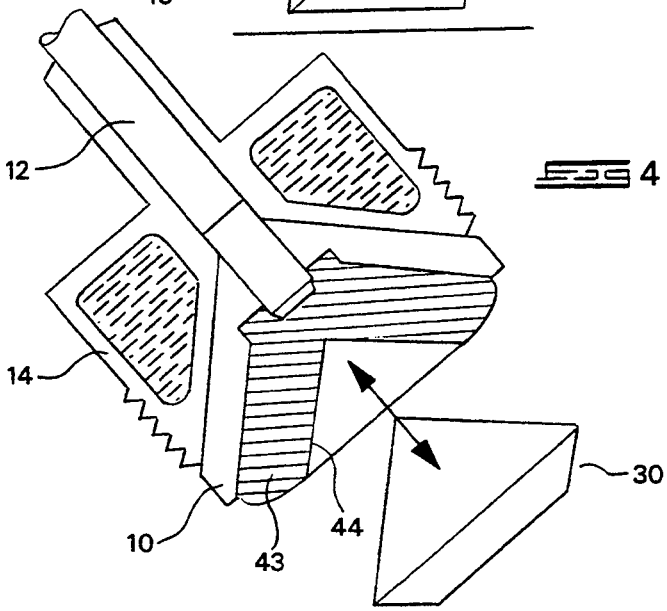
FIG 4
FIG 5
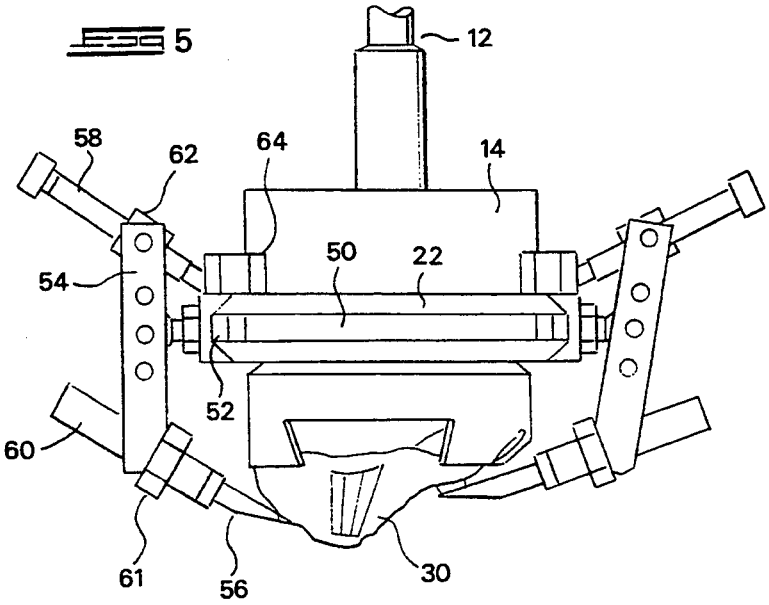

GEMSTONE HOLDING APPARATUS

This application is a continuation application Ser. No. 07/904,693, filed Jun. 26, 1992, now abandoned.

BACKGROUND TO THE INVENTION

This invention relates to a gemstone holding apparatus for holding a gemstone during polishing thereof.

The specification of South African patent application 90/7353 describes a dop structure which can be used to hold a gemstone, such as a diamond, and bring the gemstone against the abrasive surface of a rotating scaife (a revolving wheel used in polishing diamonds) so that a desired facet is formed at the surface of the gemstone.

It is known that the abrasive action of the scaife on the gemstone generates considerable heat. Excessive heat can cause temperature degradation of the stone.

SUMMARY OF THE INVENTION

A first aspect of the invention provides a method of polishing a gemstone in which a fluent coolant is placed in heat exchange relationship with the gemstone to limit the rise in temperature experienced by the gemstone during polishing.

In the preferred embodiments, liquid coolant is passed through a coolant chamber which is in heat conducting relationship with the gemstone, the coolant chamber being included in apparatus which is used to hold the gemstone during polishing thereof.

Another aspect of the invention provides a gemstone holding apparatus for holding a gemstone during polishing thereof, the apparatus comprising means for placing a fluent coolant in heat exchange relationship with the gemstone, thereby to remove heat from the gemstone during polishing.

The preferred apparatus includes holding means for holding the gemstone, a coolant chamber which is incorporated in the holding means and which is operatively in heat conducting relationship with the gemstone, and means for passing a coolant liquid through the coolant chamber. The holding means may include a stone pot of thermally conductive material for receiving the gemstone and means for holding the gemstone in the stone pot, the stone pot being in heat conducting relationship with the coolant chamber. Typically, the means for holding the gemstone in the stone pot includes adjustable claws for urging the gemstone towards the stone pot.

The apparatus may also include a thermally conductive putty for location in the stone pot between the stone pot and the gemstone, thereby to improve thermal conduction between the gemstone and the stone pot. An appropriate putty comprises a thermally conductive powder, typically a copper, aluminium, silver, graphite or diamond powder, mixed with a thermally conductive silicone grease.

BRIEF DESCRIPTION OF THE DRAWINGS

The invention will now be described in more detail, by way of example only, with reference to the accompanying drawings in which:

FIGS. 2 to 5 show the apparatus of FIG. 1 in use;

DESCRIPTION OF EMBODIMENTS

Figure 1:
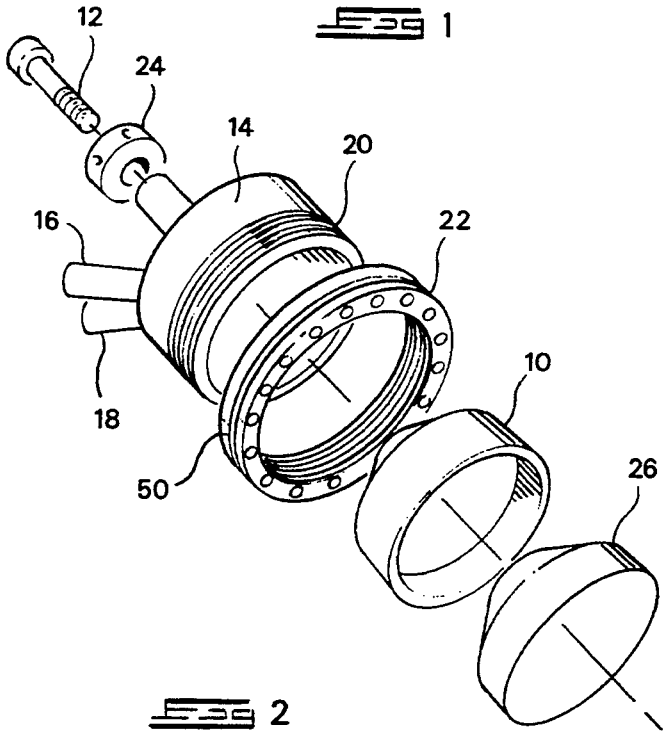
FIG. 1 shows an exploded perspective view of the components of a gemstone holding apparatus according to a first embodiment or the invention.

FIG. 1 shows the basic components of one embodiment of gemstone holding apparatus of the invention. It will be noted from the ensuing description of FIGS. 2 to 5 that not all of these components are used at all times during the polishing of a gemstone.

In FIG. 1, a stone pot, in which the gemstone is actually held, is designated with the reference numeral 10. The pot 10 is fastened to the remainder of the dop apparatus (not illustrated) by means of a pot fixing screw 12. Located alongside the pot 10 is a cooling jacket 14 which has a coolant inlet 16 and a coolant outlet 18. The lower part of the jacket 14 is externally threaded at 20. An internally threaded claw mounting ring 22 can be screwed onto the threads 20. Other components seen in FIG. 1 are an optional jacket fixing nut 24 for fastening the holding apparatus to the dop apparatus and an optional table support 26.

Figure 2:
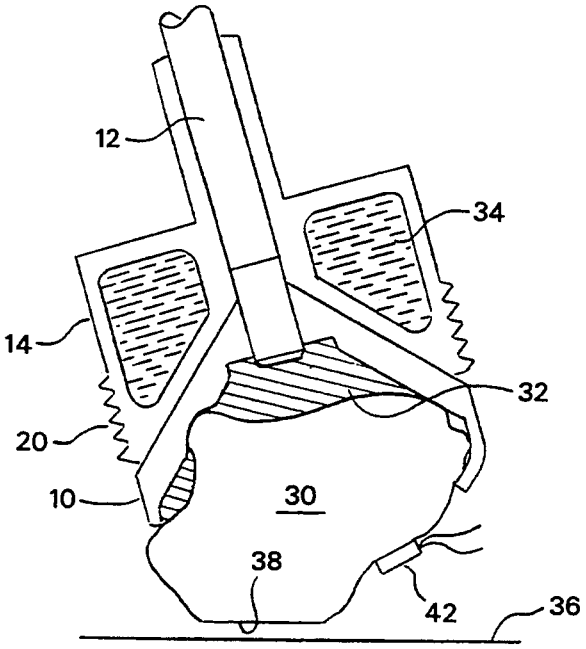

Referring now to FIGS. 2 to 4, a gemstone which is to be held by the apparatus during polishing is indicated with the numeral 30. In FIG. 2, the gemstone 30 is still in a substantially uncut state. A thermally conductive putty 32 completely fills any voids between the gemstone and the stone pot 10. It will be noted in FIG. 2 that the stone pot 10 has a shape specifically designed to accommodate the irregular exterior of the gemstone 30.

It will also be seen in FIG. 2 that the claw mounting ring, the jacket fixing nut and the table support are omitted, and that the cooling jacket 14 defines an annular coolant chamber 34.

Polishing of the gemstone 30 is achieved by moving the holding apparatus to a position in which the gemstone 30 is held against the surface 36 of a rotating scaife, which polishes a facet 38 into the gemstone. As indicated previously, excessive heat generated by the abrasive action of the scaife on the gemstone can lead to temperature degradation of the gemstone. Excessively high temperatures are avoided by making the stone pot 10, retaining putty 32 and cooling jacket 14 of thermally conductive material, and by the fact that a coolant, typically water, is passed through the chamber 34 from the inlet 16 to the outlet 18 during polishing. Thus heat generated by the polishing action is conducted to the coolant which removes it.

The putty 32 not only acts as a heat sink to conduct heat away from the gemstone 30, but it also cushions the gemstone to some extent relative to the pot 10. A preferred putty 32 consists of a highly thermally conductive powder in admixture with a heat conductive silicone grease. Typically, the powder which is used would be copper, aluminium, silver, graphite or diamond powder.

In the case of a diamond powder, the particle size would typically be in the range 0.1 to 0.5 micron. Larger particles are generally to be avoided because of their potential to scratch the gemstone 30. The exact proportions of conductive powder and silicone grease will depend on the circumstances of each case, and will be chosen to balance the workability or malleability of the putty against the desired thermal conduction properties. Suitable silicone grease may be that marketed under the names ELECTROLUBE HTC 010 or UNICK UH102, which provide a re-usable and easily workable base for the putty 32.

In situations where a greater degree of workability is required, a suitable plasticiser can be added to the putty.

FIG. 3 shows a slightly different arrangement in which a table support 26 is mated with the pot 10 to provide an appropriately shaped surface for the gemstone 30, which has already undergone substantial polishing. If necessary, a putty similar to the putty 32 can also be interposed between the gemstone and relevant surfaces of the table support to fill any voids and ensure adequate conduction of heat.

It will be noted that the apparatuses seen in FIGS. 1 and 2 include thermal sensors 42 attached to the gemstone 30 at suitable positions for the purposes of monitoring the temperature of the gemstone.

In FIG. 4, the inner surface of the pot 10 has a lining of heat conductive solder or resin 42 which has a depression 44 precisely matched to the shape of the relevant part of the gemstone 30, in this case the culet thereof.

Since it is critical that the gemstone 30 is properly immobilised during cutting, it is additionally clamped by means of a clamping arrangement as seen in FIG. 5, which shows the claw mounting ring 22 in position on the cooling jacket 14. The claw mounting ring is formed with a circumferential groove 50 in which projections 52 can be located. The projections 52 are pivoted to links 54 which carry claws 56 at their lower free ends and clamp screws 58 at their upper free ends.

The claws have threaded shanks 60 which engage with locking nuts 61 engaged with the links 54, so that the claws can be adjusted, in their longitudinal directions, according to the specific requirements of the gemstone. Similarly, the clamp screws 58 are threaded through pivoting blocks 62 on the links 54, so that they are also longitudinally adjustable. The clamp screws 58 carry pivoting formations 64 at their inner ends that bear against the periphery of the cooling jacket 14. It will be appreciated that the combination of claws and clamp screws, properly tightened, will substantially immobilise the gemstone 30 during polishing, at any chosen one of a great variety of different diamond positions and orientations.

Figure 6:
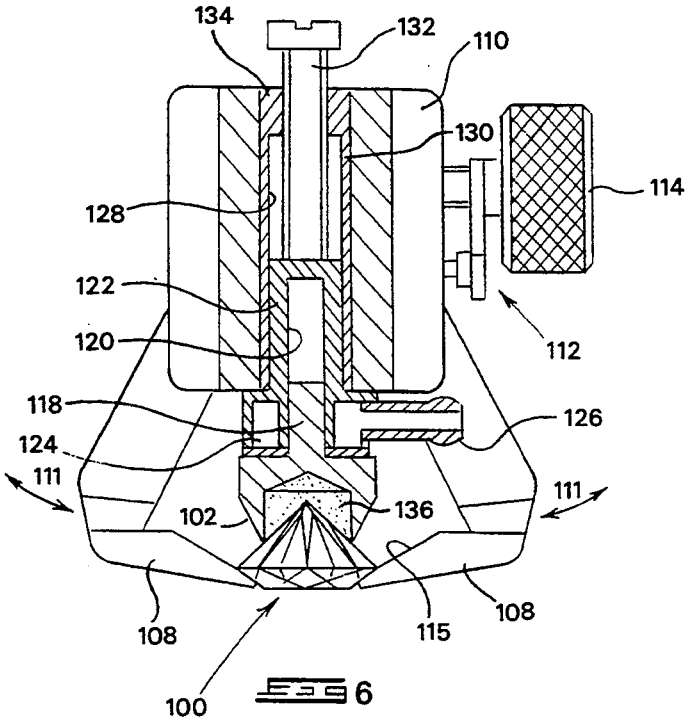
FIG. 6 shows a cross-sectional view of a second embodiment of the invention.
Figure 7:
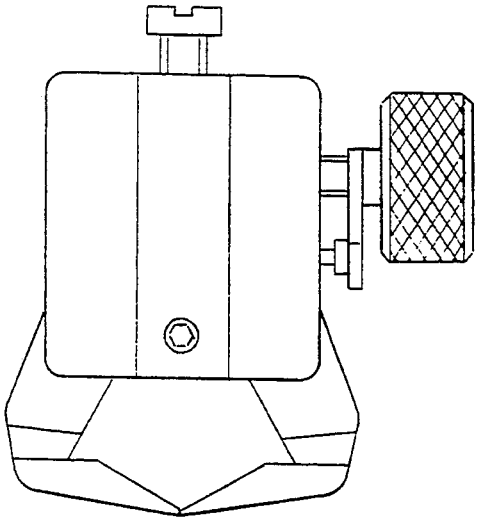
FIG. 7 shows a side elevation of the embodiment of FIG. 6.

FIGS. 6 and 7 illustrate another embodiment of the invention holding a gemstone 100, in this case a diamond, at an advanced stage of polishing. The holding apparatus in this case has a stone pot 102 in which the culet of the diamond is received. The crown of the diamond is gripped by a pair of claws 108 which are pivotally suspended on a body 110. Pivotal movement of the claws, in the manner indicated by the arrows 111, is achieved by a control linkage, partially seen at 112 and controlled by a thumbscrew 114. The claws have inclined surfaces 115 which bear against the crown of the diamond 100 and urge it upwards into firm engagement with the stone pot 102.

The stone pot 102 and the element 122 are omitted from FIG. 7. The stone pot 102 has a projecting tail portion 118 that is fixed, by means of a grub screw, inside a passage 120 in a hollow element 122. The hollow element 122 has an internal coolant chamber 124 through which a suitable coolant is circulated via nipples 126, only one of which is visible.

The upper part of the element 122 is located in a bore 128 defined by a sleeve 130 and is locked in positon by a grub screw. A screw 132 passes through a threaded aperture in a cap 134 at the upper end of the sleeve and bears upon the upper part of the element 122. The screw 132 is used to adjust the vertical position of the element 122 and hence of the stone pot 102 and diamond to position the diamond at a suitable height to be engaged firmly by the claws 108 which are, as stated above, moved by appropriate rotation of the thumbscrew 114.

The space between the surfaces of the stone pot 102 and the diamond is filled with a thermally conductive medium 136, such as a putty, solder or resin. At least the element 122 is made of a material having high thermal conductivity, such a copper. The pot 102 is typically made of steel.

The orientation of the diamond in FIG. 6 is suitable for polishing the crown and table of the diamond, but a similar arrangement, with a suitable design of stone pot 102 and claws 108, can be used for polishing of the bottom of the diamond. During polishing, the heat generated in the diamond by the scaife is conducted to the coolant flowing through the chamber 124 by the medium 136, the stone pot 102 and the element 122. The coolant removes a substantial mount of the heat, thereby preventing overheating and resultant temperature degradation of the diamond. A further advantage is that the apparatus is cooled down for ease of handling.

Figure 8:
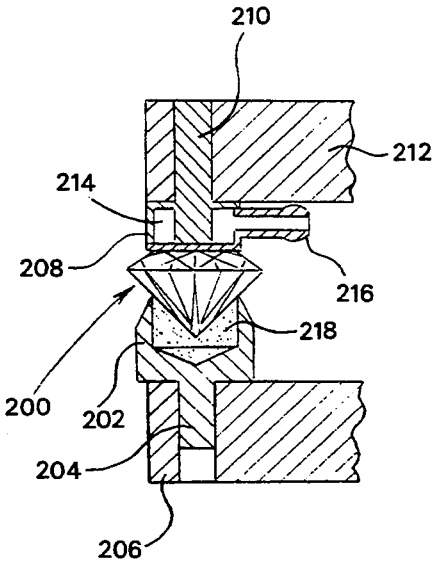
FIG. 8 shows a cross-sectional view of a third embodiment of the invention.

In FIG. 8 the culet of a diamond 200 is received within a stone pot 202. The stone pot has a projecting tail portion 204 fixed in a passage in a body 206. A fiat surface of an element 208, similar to the element 122 of FIG. 6, bears upon the table of the diamond. The element 208 has a portion 210 fixed into a passage in a body 212. The bodies 206 and 212 are arranged so that the diamond 200 is clamped firmly in position for polishing of the appropriate girdle facets.

The element 208 defines a coolant chamber 214 through which coolant is circulated via nipples 216 (only one visible). As in the previous embodiments, any space between the diamond and the stone pot can be filled with a thermally conductive medium 218, and at least the element 208 is made of thermally conductive material. As before the presence of the coolant removes heat from the diamond during polishing and reduces the chances of excessive temperatures and thermal degradation of the diamond.

Initial testwork indicates that an apparatus of the kind described above is suitable for use in polishing diamonds of greater than one carat.

I claim:

1. A gemstone holding apparatus for holding a gemstone during polishing thereof, the apparatus comprising a gemstone pot in which a gemstone to be polished can be held, a thermally conductive putty located in the gemstone pot between the gemstone pot and the gemstone itself, thereby to improve thermal conduction between the gemstone and the gemstone pot means adjacent the pot defining a coolant chamber which is operatively in heat exchange relationship with a gemstone located in the gemstone pot, an inlet to and an outlet from the coolant chamber, and means for passing a liquid coolant from the inlet to the outlet through the chamber, so that the liquid coolant withdraws heat indirectly from a gemstone held in the gemstone pot.

2. The gemstone holding apparatus according to claim 1, comprising means for holding the gemstone in the gemstone pot.

3. The gemstone holding apparatus according to claim 2, wherein the means for holding the gemstone in the gemstone pot includes adjustable claws for urging the gemstone into the gemstone pot.

4. The gemstone holding apparatus according to claim 1, wherein the putty comprises a thermally conductive powder mixed with a thermally conductive silicon grease.

5. The gemstone holding apparatus according to claim 4, wherein the thermally conductive powder is one selected from the group consisting of copper, aluminum, silver, graphite and diamond powder.

* * * * *